United States Patent [19]

Rossborough et al.

[11] Patent Number: 4,711,258

[45] Date of Patent: Dec. 8, 1987

[54] APPARATUS FOR CLEANING PAINT ROLLER

[75] Inventors: Richard F. Rossborough, Gladstone Park; Graeme Whitty, Springvale South, both of Australia

[73] Assignees: M. J. Chapman; G. K. Sherlock; J. F. Kilby; R. W. Robertson, all of Victoria, Australia

[21] Appl. No.: 882,405

[22] Filed: Jul. 7, 1986

[30] Foreign Application Priority Data

Jul. 5, 1985 [AU] Australia ..... PH01338
Aug. 13, 1985 [AU] Australia ..... PH01917

[51] Int. Cl.[4] ..... B08B 3/02
[52] U.S. Cl. ..... 134/138; 134/149
[58] Field of Search ..... 68/213; 134/138, 140, 134/149, 151, 153; 248/74.2, 316.7, 526, 535; 239/525

[56] References Cited

U.S. PATENT DOCUMENTS 2,243,554 5/1941 Epstein ..... 248/316.7 X
2,725,065 11/1955 Wilsing ..... 68/213 X
2,773,274 12/1956 Beech ..... 134/149 X
2,809,004 10/1957 Kaufman et al. ..... 248/74.2 X
3,126,899 3/1964 Caywood ..... 134/138
3,576,304 4/1971 Gillemot et al. ..... 248/74.2
3,897,797 8/1975 Wright et al. ..... 134/138 X
4,549,562 10/1985 Ossi ..... 134/138

FOREIGN PATENT DOCUMENTS 2623040 11/1977 Fed. Rep. of Germany ..... 248/74.2

*Primary Examiner*—Philip R. Coe
*Attorney, Agent, or Firm*—Cushman, Darby & Cushman

[57] ABSTRACT

An apparatus for cleaning a paint roller having a handle, connecting arm (17) and roller cover (18), the apparatus consisting of a hollow cylindrical housing (1), a water outlet member (10), and a locating clip (6) with three pairs of fingers for resiliently holding the connecting arm (17) of the paint roller in a predetermined position while water under pressure from the water outlet member (10) is directed so as to strike the roller cover (18) such that the roller cover (18) rotates thereby cleaning the paint roller.

12 Claims, 7 Drawing Figures

APPARATUS FOR CLEANING PAINT ROLLER

This invention relates to apparatus for cleaning paint rollers.

A common method of applying paint to substrates, particularly in the domestic situation, is by roller. A roller comprises a rotatable mounting piece on which is placed a roller cover, a handle and a connecting arm connecting the handle to the rotatable mounting piece. Upon completion of painting the roller requires cleaning by removal of paint entrained in the roller cover. One method of cleaning the roller is to immerse the roller cover in a solvent for the paint. In the case of water based paints this is usually water and cleaning can be accomplished using water from a hose or tap. Cleaning in this fashion is usually time consuming, requiring the attention of an operator, can be incomplete, and splash the operator with paint. Incomplete cleaning is deleterious to the roller cover. An apparatus for cleaning paint rollers has been proposed in Australian patent application No. 30269/77. In this specification a shaft is provided for mounting the roller cover together with drive means for rotating the shaft at high speed. Such apparatus has the disadvantage of requiring the roller cover to be removed from the paint roller before the cover is cleaned, thereby exposing the operator to the risk of getting paint on himself. It also has the disadvantage of requiring the complexity of a mechanical drive means.

Other types of apparatus for cleaning paint rollers have been proposed which are attachable to an empty paint roller tray and in which a hand held hose nozzle is directed on the roller cover causing it to rotate. A disadvantage of this type of apparatus is that it requires the hose nozzle to be accurately positioned and constantly held whilst the cleaning operation is taking place. Furthermore, it is sometimes inconvenient to have to use the paint tray as it may still be required to hold paint.

It is an object of the present invention to provide a paint roller cleaning apparatus which overcomes at least some of the above problems.

Accordingly, in one form this invention provides an apparatus for cleaning paint rollers comprising a housing adapted so as to allow a paint roller cover to be inserted inside the housing, a water outlet member located within the housing characterised in that the housing further comprises a locating member for locating a connecting arm of a paint roller such that the paint roller cover can be located within the housing and wherein the water outlet member is so arranged that in operation water emerges under pressure from the water outlet member, strikes the roller cover and causes the roller to rotate, the housing further comprising a drainage opening adapted to allow, in operation, water to be drained from the housing.

Preferably the locating member is adapted to resiliently hold the connecting arm of the paint roller in a fixed predetermined position while the cleaning process is in operation.

More preferably the locating member is further adapted to allow adjustable movement of the connecting arm in radial and vertical axial directions of the housing whereby the paint roller is located in the predetermined position.

Preferably the locating member comprises three pairs of finger members adapted to resiliently hold the connecting arm of the paint roller in the predetermined position but allow adjustable movement of the connecting arm in the radial and vertical axial directions of the housing.

In a further preferred form the water outlet comprises a plurality of holes in a tube member positioned inside the housing member wherein the tube member is adapted to be connected to a water supply outlet. Preferably the tube member is positioned such that, in use, water is directed from the holes at an angle to the radial direction of the roller cover of between 15° and 60° and more preferably 20° to 40° and even more preferably 25° to 35°. In a particularly preferred form the housing is of generally hollow cylindrical shape.

One preferred form of the paint roller cleaning apparatus of the invention will now be described with reference to the accompanying drawings in which.

Figure 4:
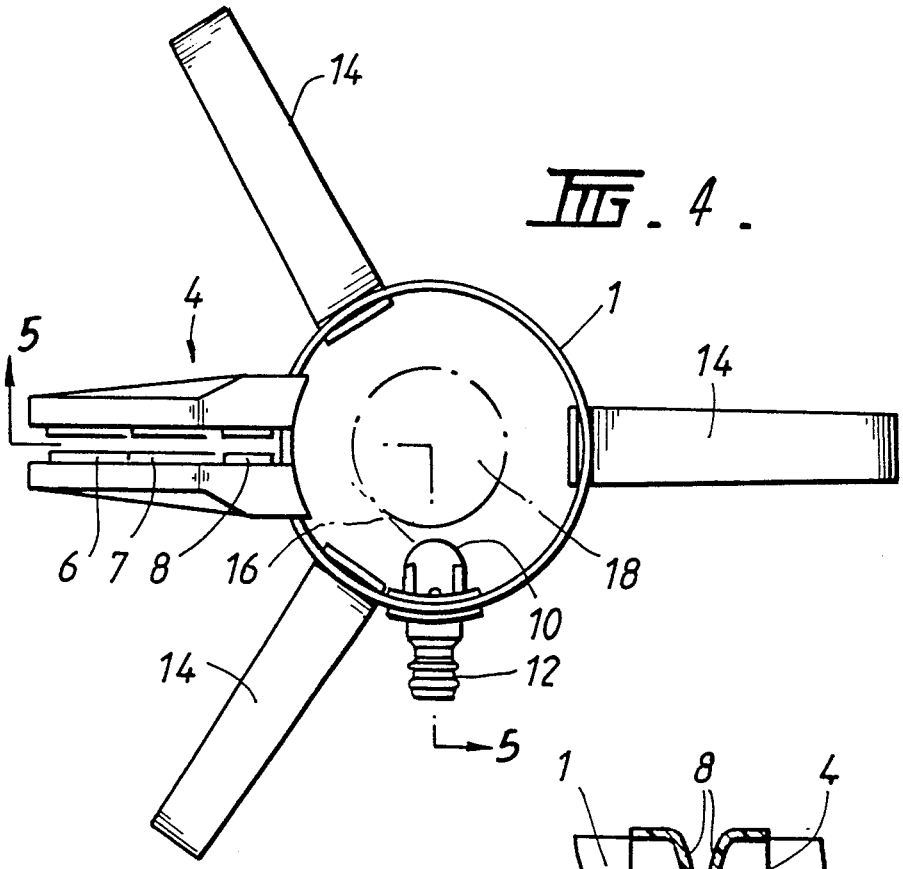
FIG. 4 is a plan view of the apparatus.
Figure 7:
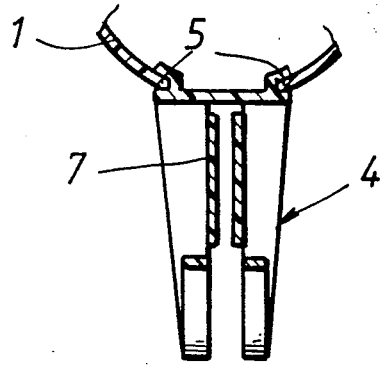
FIG. 7 is a sectional view through 7—7 of FIG. 6.
Figure 6:
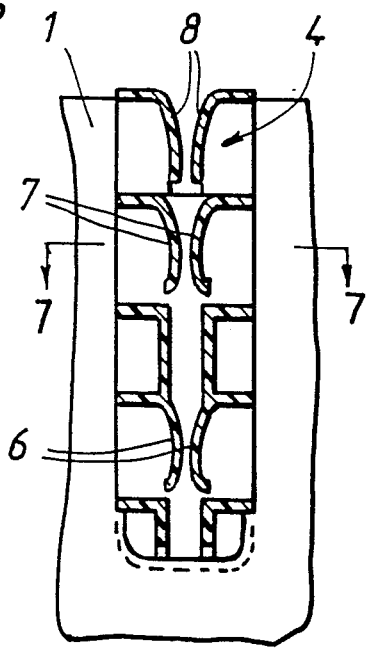
FIG. 6 is a cross-sectional view through 6—6 of FIG. 5.

Referring to the drawings, according to the invention, the apparatus for cleaning paint rollers consists of a hollow cylindrical housing 1, of internal diameter 100 mm, wall thickness of 3.5 mm and made of polyvinyl chloride. The housing is open at the top 2 to allow a roller cover to be inserted into the housing, and a drainage opening 3 to allow water to drain away. Attached to the housing 1 is a locating member 4 which is detachable from the housing 1 and engagable in an opening in the housing by mating recess 5. Referring in particular to FIGS. 4 and 6 the locating member 4 has three pairs of finger members, 6, 7 and 8.

Figure 5:
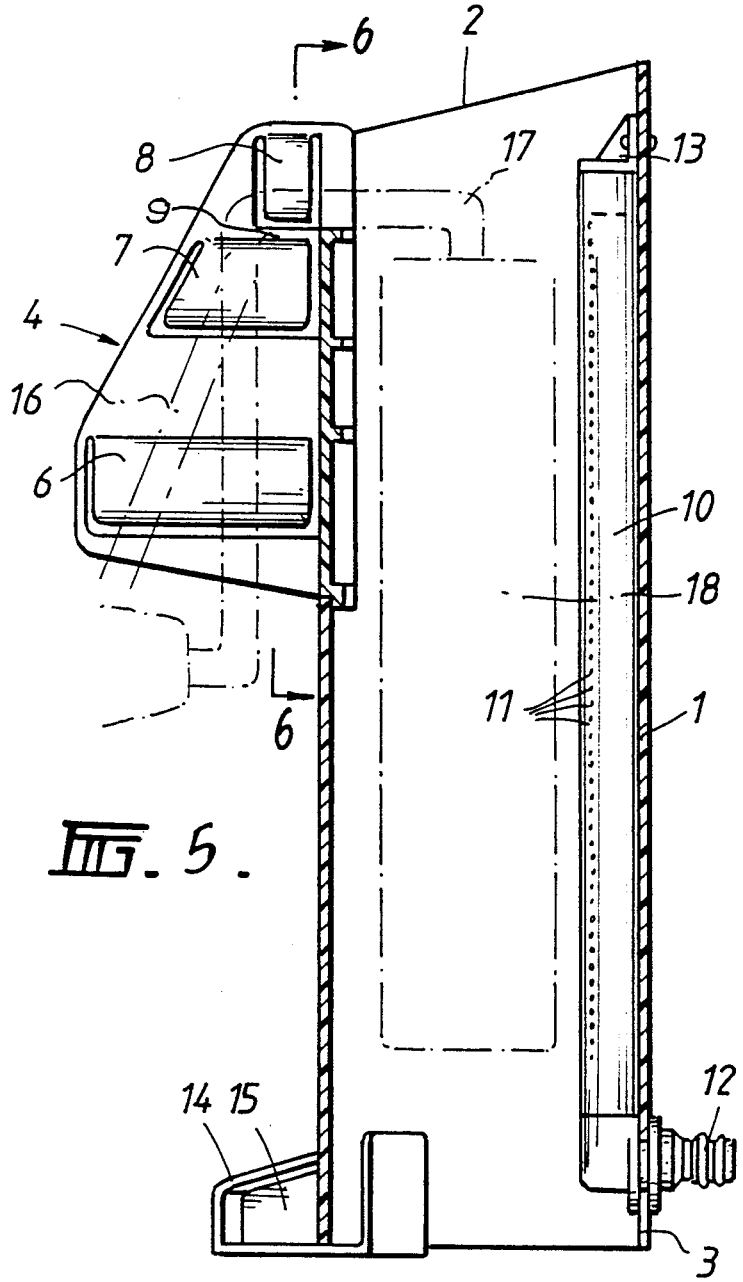
FIG. 5 is a cross-sectional view through 5—5 of FIG. 4.

The fingers are made of resilient material, such as polypropylene or other plastic materials. The gap between the fingers of each pair is approximately 4.5 mm and this enables connecting arms of between approximately 6 and 10 mm in diameter to be adjustably located to a predetermined position. It also allows location of connecting arms which have some build up of paint to be adjustably located. Pairs of finger members 6 and 7 allow the paint roller to be adjusted in radial and vertical axial directions of the housing 1. The resilient force exerted on the connecting arm by the pairs of fingers is sufficient to enable the paint roller to be located fixedly whilst the apparatus is in operation. The arrangement of pairs of fingers also enables connecting arms 16 of other than right angle configuration to be held as shown in FIG. 5. This is provided by having the lowest, (with the housing in upright position) pair of fingers 6 of sufficient length to locate the arm where the angle 9 is more than 90°, for example 130°. Referring to FIGS. 4 and 5, located on the inside of the housing 1 is a water outlet tube 10 made of polycarbonate plastic with bore diameter of 12.5 mm and outside diameter of 16 mm. There is a row of 57 holes, 11, each of diameter 0.5 mm and at approximately 5 mm spacings along the outlet tube 10.

Figure 1:
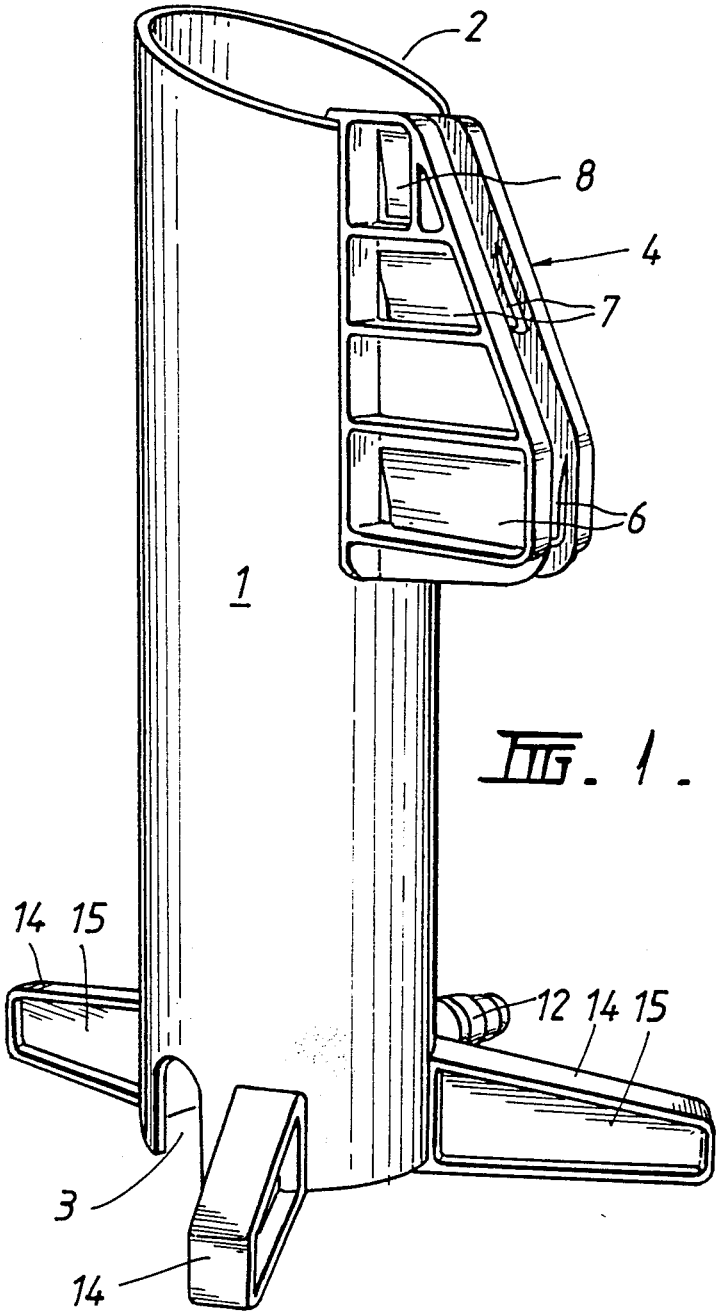
FIG. 1 is a perspective view of the apparatus according to the invention
Figure 2:
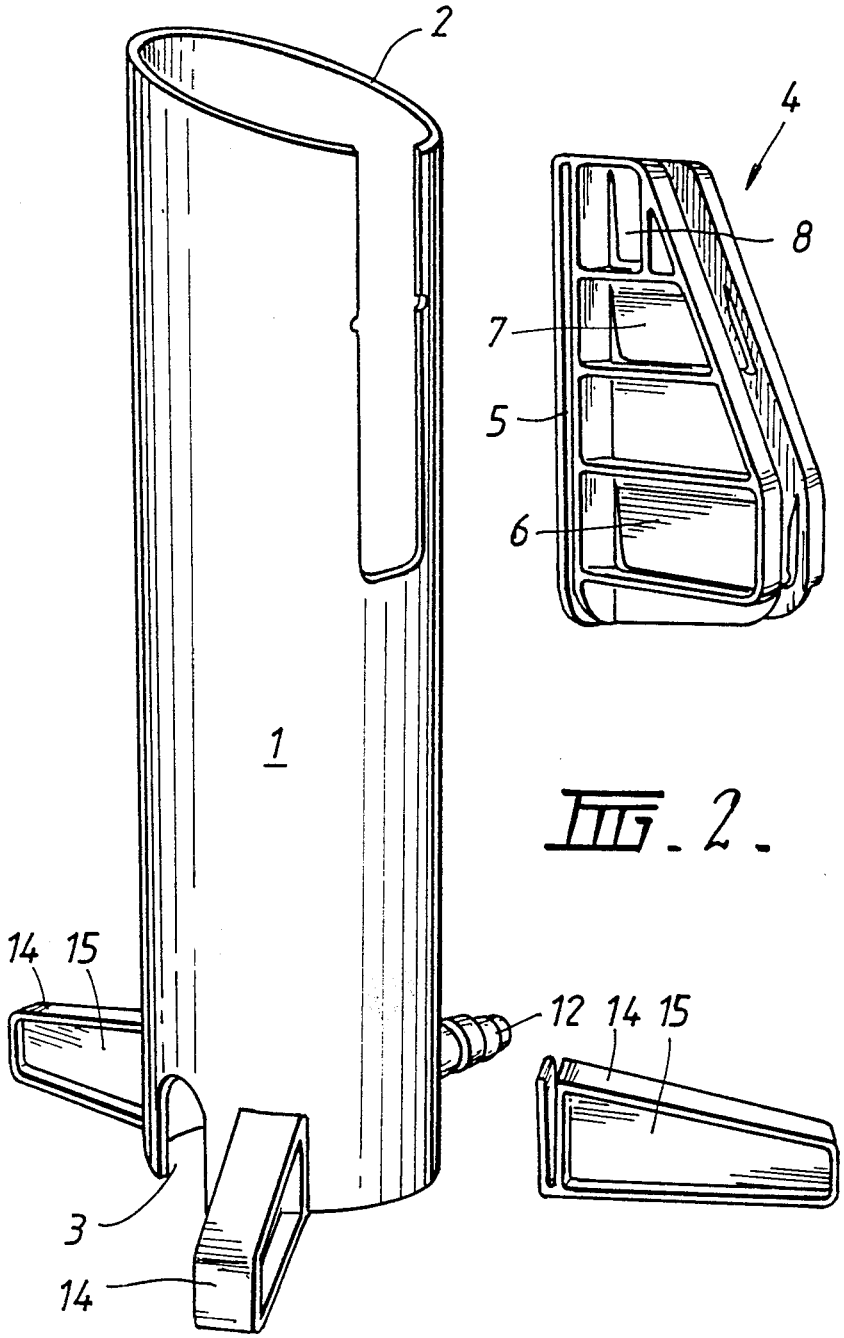
FIG. 2 is a perspective view of the apparatus according to the invention in disassembled form.
Figure 3:
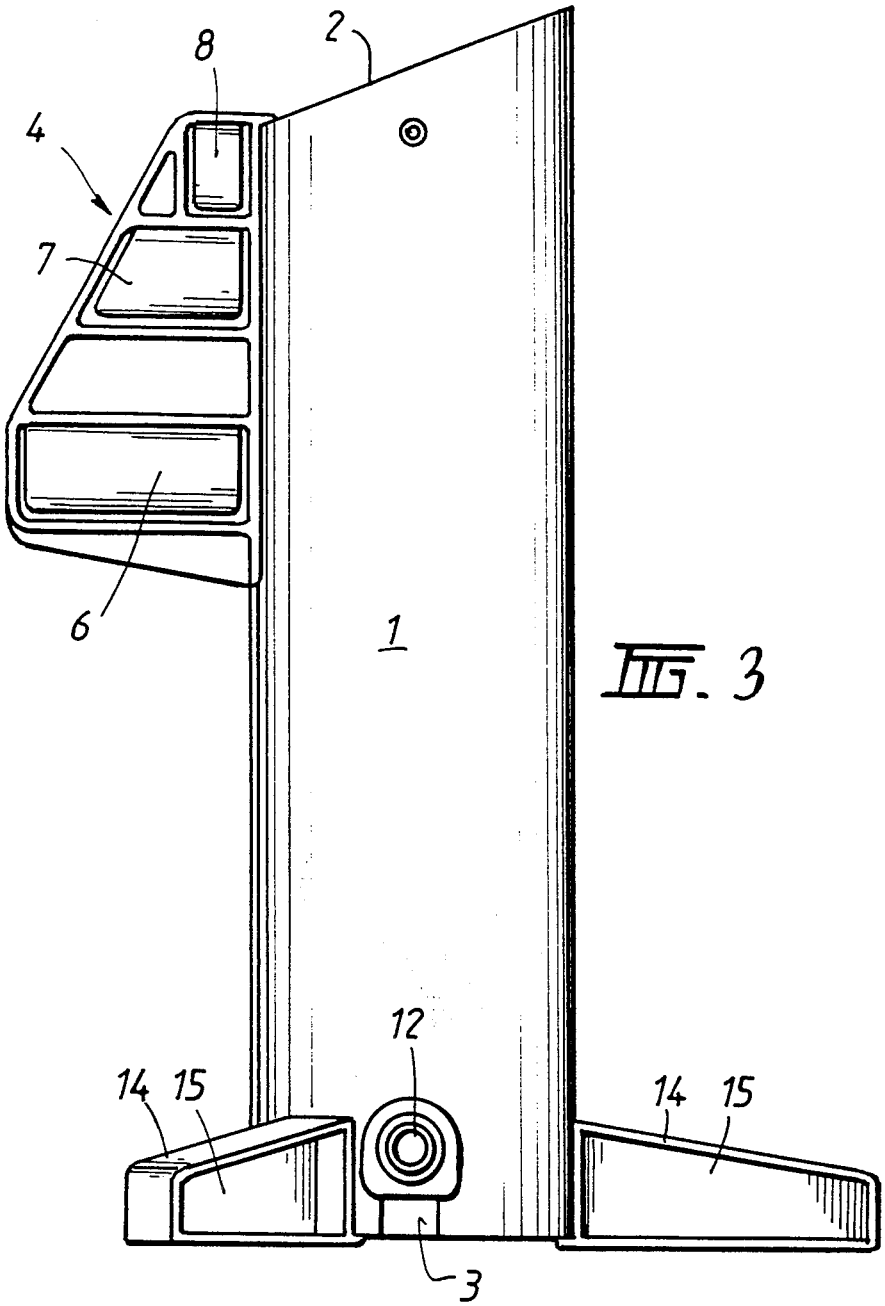
FIG. 3 is a side elevation view of the apparatus according to the invention.

One end of the outlet tube 10 is connected to a water inlet adaptor 12 and the other end of the outlet tube is sealed with a cap 13 which is attached by a rivet to the housing 1. The outlet tube 10 is arranged so that the row of holes 11 is at an angle of 30° to a radius of the housing, as shown in FIG. 4. If the angle is less than approximately 15° the spinning effect on the paint roller tends to be insufficient to efficiently clean the roller cover. If the angle is greater than 60° the water emerging from the holes does not penetrate the roller cover material to thoroughly clean the roller cover. The number and diameter of the holes are selected so as to ensure sufficient spinning force on the roller even when low pressure sources of water are connected to the inlet adaptor 12. Apart from circular holes other apertures including slots could be also used provided sufficient force was transferred to the roller cover to allow suitable rotation of the roller cover. The housing is further supported by three legs 14 having a central web 15. These legs are detachable for packaging, as shown in FIG. 2, and provide additional stability to the apparatus in operation.

In the cleaning operation a paint roller with paint entrained in the roller cover 18, is inserted and held between the three pairs of fingers, 6,7,8 of the clip 4. The position of the roller is adjusted by vertical movement axially and radially to the housing 1 so as to locate the roller cover fully within the housing and with the axis of the roller cover approximately corresponding to the vertical control axis of the housing 1. Water under pressure, such as from a conventional domestic water supply, is introduced into the tube 10, via inlet 12, and emerges from the row of holes 11.

The position of the row of holes 11 ensures that the water is directed at an angle of approximately 30° to the radial direction of the roller cover causing the roller cover to rotate together with the rotatable mounting member part of the paint roller. The resulting centrifugal action causes paint entrained in the roller cover and diluted with water to be forced off the roller to the inside of the housing whereupon under gravity the diluted paint falls and drains from the casing. It will be appreciated that whilst drainage openings 3 are provided drainage may also be effected by having the base of the housing 1 open. Continuation of this process cleans the roller. The shape of the housing and the arrangement of the locating means ensures that diluted paint is not sent through the opening onto the operator. It will be appreciated that this apparatus enables cleaning of a roller cover without the necessity for handling the roller cover and without close attention. Moreover this apparatus has no moving parts that may wear and deteriorate.

Various modifications of the preferred apparatus are within the scope of the invention and these include the water outlet being a continuous slit in the tube or a series of jets. The water outlet could also be encased within the housing or even be outside the housing provided the outlet holes are able to direct water into the roller cover. The connector 12 could alternatively be located in other positions including a position at the top of the tube which would enable direct fitting to a mating fitting from a domestic garden tap. Certain types of rollers have differently shaped connecting arms and the locating means of the apparatus of the present invention may be modified to suit these other types of rollers. Alternatively an adaptor that fits over the connecting means may be used to locate these other types of rollers. The preferred shape of the housing is hollow cylindrical as this shape provides better removal of the diluted paint, however, other shapes such of square or rectangular cross section would also be suitable. The apparatus may be made of any suitable material but preferred materials are plastic and the preferred construction technique is injection moulding.

The claims defining the invention are as follows:

We claim:

1. An apparatus for cleaning a paint roller having a paint roller cover and a connecting arm, comprising:

an elongated tubular housing having opposed ends at least one of which is open for receiving the paint roller cover longitudinally in the housing;

a plurality of support legs separately detachably connected to said housing at the opposite end thereof for supporting the housing in an upright position with said open end uppermost;

a liquid outlet tube fixed along the housing and having a plurality of holes spaced therealong and opening into the housing, so that, in use, liquid may spray from the holes into the housing;

a drainage opening at said opposite end of the housing, and through which, in use, liquid may drain from the housing; and a locating member removably attached to the housing adjacent said open end for locating the connecting arm of the roller such that, in use, the paint roller cover is positioned within the housing at such a location that liquid sprayed from the fixed liquid oulet tube holes will strike the roller causing it to rotate, said locating member including a plurality of pairs of resilient flexible fingers, the fingers of each pair being arranged in spaced-apart relationship so as to define a gap therebetween in which the connecting arm is receivable for releasable gripping between the fingers, so that the connecting arm may be manually slid between the fingers, while remaining positively gripped therebetween, in directions across and along the fingers for altering longitudinal and lateral disposition of the paint roller cover within the housing relative to the outlet tube holes.

2. An apparatus as claimed in claim 1, wherein:

said fingers extend longitudinally in a direction generally radially of the housing, and the fingers of each pair extend parallel to one another in the radial direction so as to define a radial slot-like gap therebetween, so that the connecting arm may be moved along and through the gaps during manual sliding thereof.

3. An apparatus as claimed in claim 2, wherein:

said pairs of fingers are spaced apart longitudinally of the elongate housing, and are arranged so that the gaps are aligned longitudinally of the housing to receive the connecting arm therein.

4. An apparatus as claimed in claim 3, wherein:

said housing has an opening at one end thereof through which the connecting arm may pass when located by the locating member, the locating member being mounted on the housing adjacent the opening, and the pairs of fingers being progressively spaced along the housing from the opening and extending radially from the housing in successively increasing length.

5. An apparatus as claimed in claim 4, wherein:

the fingers of each said pair have opposed location faces between which the respective said gaps are defined, said location faces being disposed for engaging upon the connecting arm to grip the connecting arm, and the location faces of each said pair projecting toward one another in a direction across the fingers.

6. An apparatus as claimed in claim 5, wherein:
the location faces of each pair convexly curve toward one another in a direction across the fingers and longitudinally of the housing.

7. An apparatus as claimed in claim 1, wherein:
three pairs of said fingers are provided.

8. An apparatus as claimed in claim 1, wherein:
said hole openings of said liquid outlet member are arranged so that, in use, the emeging liquid may make an angle of between 10 and 60 with the radius of the housing.

9. An apparatus as claimed in claim 8, wherein:
said angle is between 20 and 40.

10. An apparatus as claimed in claim 1, wherein:
said opposite end of said housing is also open and at least three support legs are provided, each support leg having a slot for slidably receiving the tubular housing wall at said opposite open end so that the housing wall is frictionally gripped by the support legs to thereby connect the legs thereto.

11. An apparatus for cleaning a paint roller having a connecting arm and a paint roller cover and a connecting arm, comprising:
an elongated housing for receiving the paint roller cover therein;
a liquid outlet member having a plurality of holes opening into the housing and from which, in use, liquid may emerge under pressure;
a drainage opening in the housing through which, in use, liquid may drain from the housing; and
a locating member on the housing for locating the connecting arm of the roller such that, in use, the paint roller cover may be positioned within the housing where liquid emerging from the liquid outlet member holes may strike the roller causing the roller to rotate, the locating member including a plurality of pairs of resiliently flexible fingers, the fingers of each pair being arranged in spaced-apart relationship so as to define a gap therebetween in which, in use, the connecting arm may be received for being releasably gripped between the fingers, so that the connecting arm may be manually slid between the fingers, while remaining gripped therebetween, in directions across and along the fingers for altering longitudinal and lateral disposition of the paint roller cover within the housing relative to the outlet member holes.

12. An apparatus for cleaning a paint roller having a paint roller cover and a connecting arm, comprising:
an elongated housing having an open end for receiving the paint roller cover therein;
a liquid outlet member having a plurality of holes opening into the housing and from which, in use, liquid may emerge under pressure;
a drainage opening in the housing through which, in use, liquid may drain from the housing; and
a locating member mounted on the housing adjacent the open end for locating the connecting arm of the roller such that the paint roller cover may be positioned within the housing where liquid emerging from the liquid outlet member holes may strike the roller causing the roller to rotate, the locating member including a plurality of pairs of resilient flexible fingers extending longitudinally in a direction generally radially outwardly of the housing, progressively along the housing from the open end and extending radially from the housing in a successively increasing length, the fingers of each pair being arranged in spaced-apart relationship and extending parallel to one another in the radial direction so as to define a slot-like gap therebetween, these slot-like gaps being aligned longitudinally of the housing, the fingrs of each pair having opposed location faces between which the respective slot-like gaps are defined, the location faces of each pair convexly curving toward one another in a direction across the fingers and longitudinally of the housing, so that, in use, the connecting arm may be slidably received in the gaps for being releasably gripped between the opposed location faces of the fingers, and so that the connecting arm is manually slidable along and across the location faces while remaining positively gripped therebetween for altering the longitudinal and lateral positions of the paint roller cover within the housing relative to the outlet member holes.

* * * * *